US010262785B2

(12) United States Patent
Taméz Torres

(10) Patent No.: US 10,262,785 B2
(45) Date of Patent: Apr. 16, 2019

(54) PRESS-CLAMP WITH CLAMPING FORCE SENSOR FOR ELECTRIC TRANSFORMER WINDING

(71) Applicant: PROLEC-GE INTERNACIONAL, S. DE R. L. DE C. V., Apodaca (MX)

(72) Inventor: Gerardo Taméz Torres, Guadalupe (MX)

( * ) Notice: Subject to any disclaimer, the term of this patent is extended or adjusted under 35 U.S.C. 154(b) by 43 days.

(21) Appl. No.: 15/685,598

(22) Filed: Aug. 24, 2017

(65) Prior Publication Data

US 2019/0066902 A1 Feb. 28, 2019

(51) Int. Cl.

| | |
|---|---|
| ***H01F 27/26*** | (2006.01) |
| ***H01F 27/28*** | (2006.01) |
| ***H01F 27/40*** | (2006.01) |

(52) U.S. Cl.

CPC ..... *H01F 27/263* (2013.01); *H01F 27/402* (2013.01)

(58) Field of Classification Search

CPC ..... H01F 27/263; H01F 27/402; H01F 27/26; G01L 1/242; G01L 1/162; G01L 1/12; G01L 1/16; G01L 3/06; G01L 3/101; G01L 3/1435

USPC ..... 336/105, 170, 184, 210, 212, 234; 73/862.24, 64.49, 862.01, 862.381, 73/682.42, 682.392

See application file for complete search history.

(56) References Cited

U.S. PATENT DOCUMENTS

| | | | | |
|---|---|---|---|---|
| 3,316,515 A * | 4/1967 | Bock | H01F 27/245 | 336/100 |
| 3,436,707 A * | 4/1969 | Andersen | H01F 27/263 | 336/134 |
| 3,810,058 A * | 5/1974 | White | H01F 27/306 | 29/602.1 |
| 2012/0247229 A1* | 10/2012 | Woodcock | H01F 27/402 | 73/862.624 |

* cited by examiner

*Primary Examiner* — Mang Tin Bik Lian
(74) *Attorney, Agent, or Firm* — Michael W. Goltry; Robert A. Parsons; Parsons & Goltry, PLLC

(57) ABSTRACT

A press-clamp for an electric transformer winding formed by an upper plate having a free inner face with a first concentric circular protrusion, and an outer face joined to a concentric nut that can be screwed along a threaded bolt; a clamping force sensor having a ring-shaped body; and a lower plate having a peripheral wall defining a cavity with a second concentric protrusion and housing the ring-shaped body of the clamping force sensor and the upper plate by its inner face, the ring-shaped body of the clamping force sensor placed concentrically when aligned with the first protrusion and the second protrusion.

12 Claims, 4 Drawing Sheets

PRESS-CLAMP WITH CLAMPING FORCE SENSOR FOR ELECTRIC TRANSFORMER WINDING

TECHNICAL FIELD OF THE INVENTION

This invention relates to electric transformers of the type comprising a magnetic core provided with columns and one or more windings wound concentrically to each column and firmly clamped to the magnetic core by one or more press-clamps. More specifically, the invention relates to an improved configuration of a press-clamp that concentrically includes a ring-shaped body of a clamping force sensor.

BACKGROUND OF THE INVENTION

Currently, the windings of an electric transformer must be firmly fixed to the core structure of the transformer in order to maintain them in position, resist electric shocks, and prevent their movement due to mechanical and electrical vibrations under normal electric operation conditions. Therefore, electrical transformers use rigid clamping systems to compress the transformer windings to preload value specified in order to mitigate sinuous displacement during a failure. After manufacture, however, the pressure on the transformer windings typically decreases due to changes in the materials used to build the transformer. Specifically, the degradation of the cellulose insulation spacers, placed between the windings or winding assemblies in the transformer, usually occurs over time as a result of humidity, temperature and induced mechanical stresses. These factors may reduce the ability of electrical transformers to resist short circuit events. Although they are usually f short duration, short circuit failures can result in the application of large axial and radial forces in the winding, resulting in a decrease in the capacity of the electric transformer to support future mechanical and electrical stress.

To compensate the altered cellulose insulation geometry and the corresponding decrease in pressure in the windings of the electric transformer, the clamping system can be retightened during periodic maintenance the electric transformer. However, as the operating history of the electric transformer is largely unknown, scheduled maintenance may occur too late, resulting in catastrophic problems of power failure and distribution. Otherwise, maintenance can be carried out too soon, resulting in excessive maintenance costs.

In order to maintain a compression of the windings and to provide absorption of stresses in the latter, some clamping systems are adapted with springs or hydraulic means that allow to maintain a pressure compression or semi-gradual pressure as required in the winding. Examples of such clamping systems are described in U.S. Pat. No. 1,961,761, U.S. Pat. No. 3,172,064, U.S. Pat. No. 3,772,627, U.S. Pat. No. 4,009,461 and U.S. Pat. No. 5,327,113, and in U.S. Patent Application Publication US2004/0075744.

The clamping systems described above have the disadvantage that they cannot be adjusted according to the compression that is really required, since they cannot rely on sensors that measure the contact pressure or clamping force exerted on the winding by the clamping system. In order to overcome this disadvantage, clamping force sensors have been incorporated into the clamping systems, as described in Romanian patent documents RO-70987 and RO-126339 and in the scientific publications "ABOUT AXIAL CLAMPING FORCE MONITORING AT POWER TRANSFORMER WINDINGS DURING THEIR ACTIVE LIFETIME, Andrei Marinescu and Carmen Livia Ungureanu, Annals of the University of Craiova, Electrical Engineering series, No. 32, 2008, ISSN 1842-4805; And "FIBER OPTIC BASED CLAMPING FORCE MONITORING SYSTEM FOR POWER TRANSFORMERS, Andrei Marinescu, Gheorghe Opran, Mircea Teodorescu, Ion Dinu and Luminita Tascau, Optimization of Electrical and Electronic Equipment (OPTIM), 2012 13th International Conference on, IEEE, pages 282-286.

Clamping systems incorporating clamping force sensors are generally formed by a press-clamp having an upper plate attached to a concentric nut which is screwed along a bolt forming part of the structure of the magnetic core of the electric transformer, and a lower plate with a cavity housing the ring-shaped body of the clamping force sensor and the upper plate, such that the upper plate moves in a vertical direction by screwing the concentric nut on the bolt of the core structure by compressing the body of the clamping force sensor and at the same time pushing the lower plate in a vertical direction to firmly maintain and compress the electric transformer winding. This press-clamp configuration has the disadvantage that the ring-shaped body of the clamping force sensor is not concentric with the axis of the fastener or is displaced laterally into the cavity of the lower plate as the upper plate Displaces vertically, thereby causing damage in the same body of the clamping force sensor or erroneous or inaccurate measurements of the magnitude of the clamping force applied to the winding through the press-clamp.

In view of the foregoing, it is necessary to provide a press-clamp for a winding of an electric transformer that concentrically comprises and maintains a ring-shaped body of a clamping force sensor.

SUMMARY OF THE INVENTION

In view of the foregoing and for the purpose of solving the constraints encountered, it is the object of the invention to provide a press-clamp for a winding of an electric transformer, the press-clamp includes an upper plate with a free inner face and an outer face joined to a concentric nut being screwed along a threaded bolt; a clamping force sensor with a ring-shaped body, a lower plate with a peripheral wall defining a cavity for housing the ring-shaped body of the clamping force sensor and the upper plate by its inner face; and the free inner face has a first concentric circular protrusion and the cavity of the lower plate has a second concentric circular protrusion, and the ring-shaped body of the clamping force sensor is concentric to the upper plate and the bottom plate when aligned with the first concentric circular protrusion and the second concentric circular protrusion.

It is also the object of the present invention to provide an electric transformer composed of a laminated magnetic core provided with two or more columns having upper ends interconnected by an upper yoke and lower ends interconnected by a lower yoke; an upper clamping structure and a lower clamping structure for stabilizing the laminated magnetic core; a winding concentrically wound on each column, having an upper part; and a plurality of press-clamps for pressing and securing the upper part of each winding to the upper clamping structure of the laminated magnetic core; the each press-clamp is composed of an upper plate with a free inner face and an outer face joined to a concentric nut being screwed along a threaded bolt; a clamping force sensor with a ring-shaped body, a lower plate with a peripheral wall defining a cavity for housing the ring-shaped body of the clamping force sensor and the upper plate by its inner face; and the free inner face has a first concentric circular protrusion and the cavity of the lower plate has a second concentric circular protrusion, and the ring-shaped body of the clamping force sensor is concentric to the upper plate and the bottom plate when aligned with the first concentric circular protrusion and the second concentric circular protrusion.

BRIEF DESCRIPTION OF THE DRAWINGS

Characteristic details of the invention are described in the following paragraphs in conjunction with the accompanying figures, which are for the purpose of defining the invention, but without limiting the scope thereof.

DETAILED DESCRIPTION OF THE INVENTION

Figure 1:
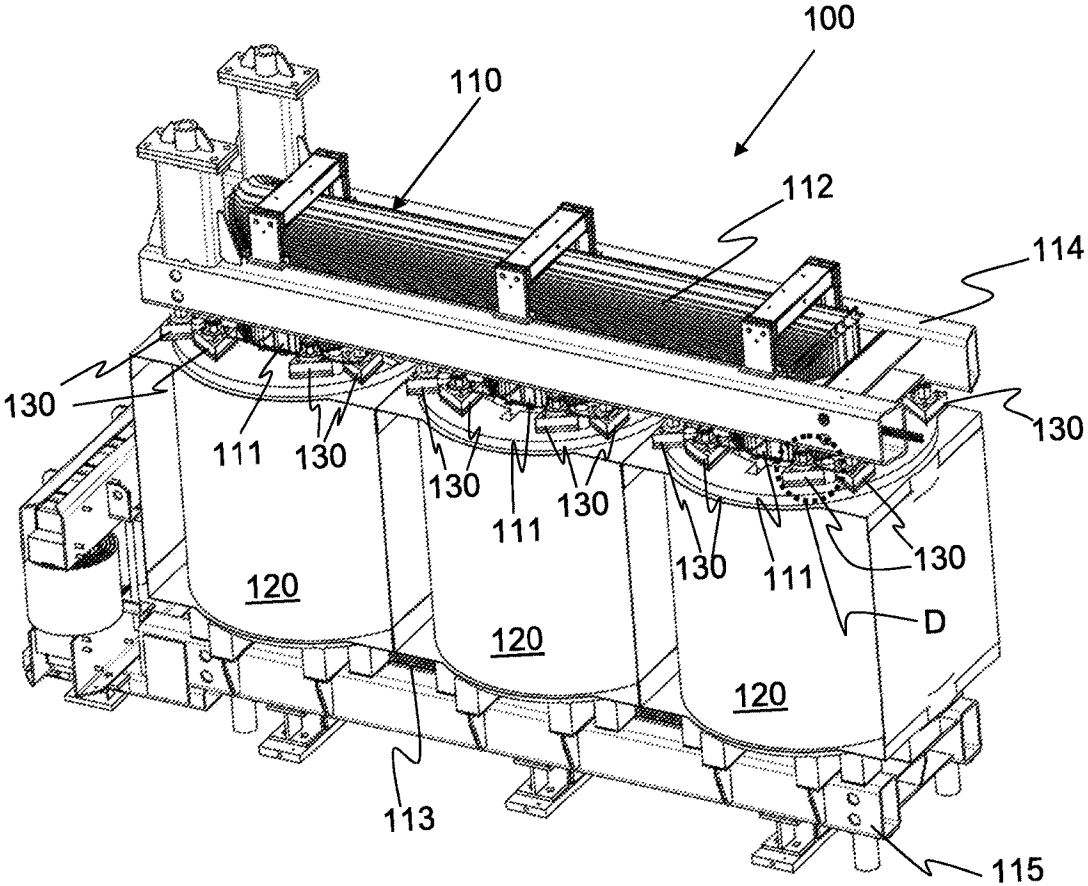
FIG. 1 shows a perspective view of the interior of an electric transformer incorporating at least one press-clamp for winding according to the invention.

FIG. 1 shows a perspective view of the interior of an electric transformer 100. The electric transformer 100 is formed by a laminated magnetic core 110, one or more windings 120 and one or more press-clamps 130.

The laminated magnetic core 110 is provided with two or more columns 111 whose upper ends are interconnected by an upper yoke 112 and its lower ends are interconnected by a lower yoke 113, whereas the laminated magnetic core 110 is being stabilized and joined by an upper clamping structure 114 and a lower clamping structure 115.

Each winding 120 is concentrically wound on each column 111, pressed and secured at its top to the upper clamping structure 114 of the laminated magnetic core 110 by a series of press-clamps 130.

Figure 2:
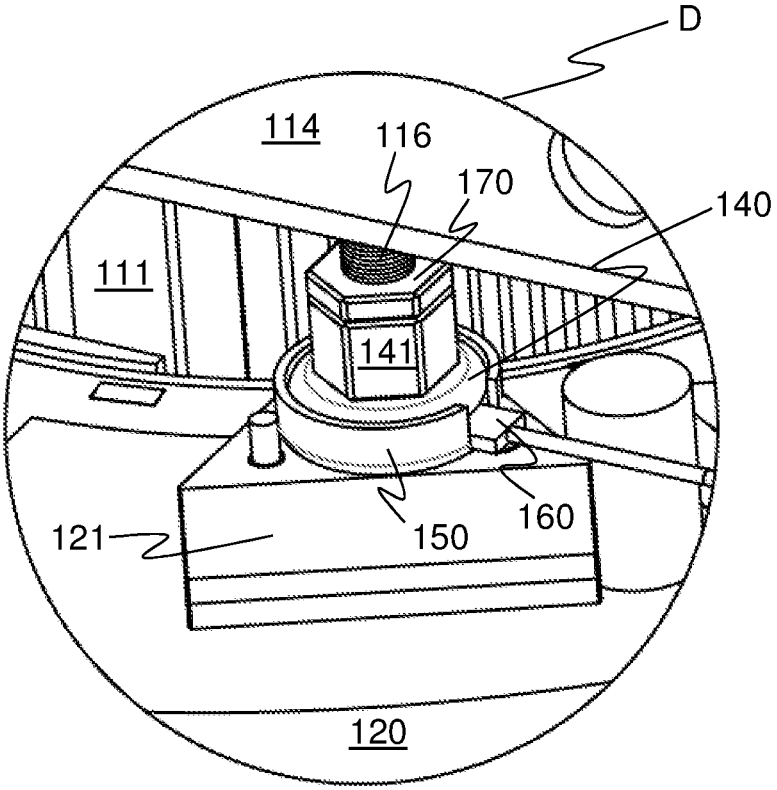
FIG. 2 shows an enlarged view of detail D of the FIG. 1, illustrating the press-clamp for winding according to the invention.

As shown in FIG. 2, each press-clamp 130 is formed by an upper plate 140, a lower plate 150 and a clamping force sensor 160. The upper plate 140 has a concentric nut 141 attached that can be screwed along a threaded bolt 116 disposed in the upper clamping structure 114 of the laminated magnetic core. The lower plate 150 has a cavity (not shown) housing the upper plate 140 and a ring-shaped body of the clamping force sensor 160. The lower plate 150 is seated on a compression insulation block 121 which is positioned at the top of the winding 120. Alternately, the press-clamp 130 has a locking nut 170, that can be crewed along the threaded bolt 116 of the upper clamping structure 114 of the laminated magnetic core, the locking nut 170 allows to maintain the position and ensure non-displacement of nut 141 of the upper plate 140, once nut 141 is adjusted.

Figure 3:
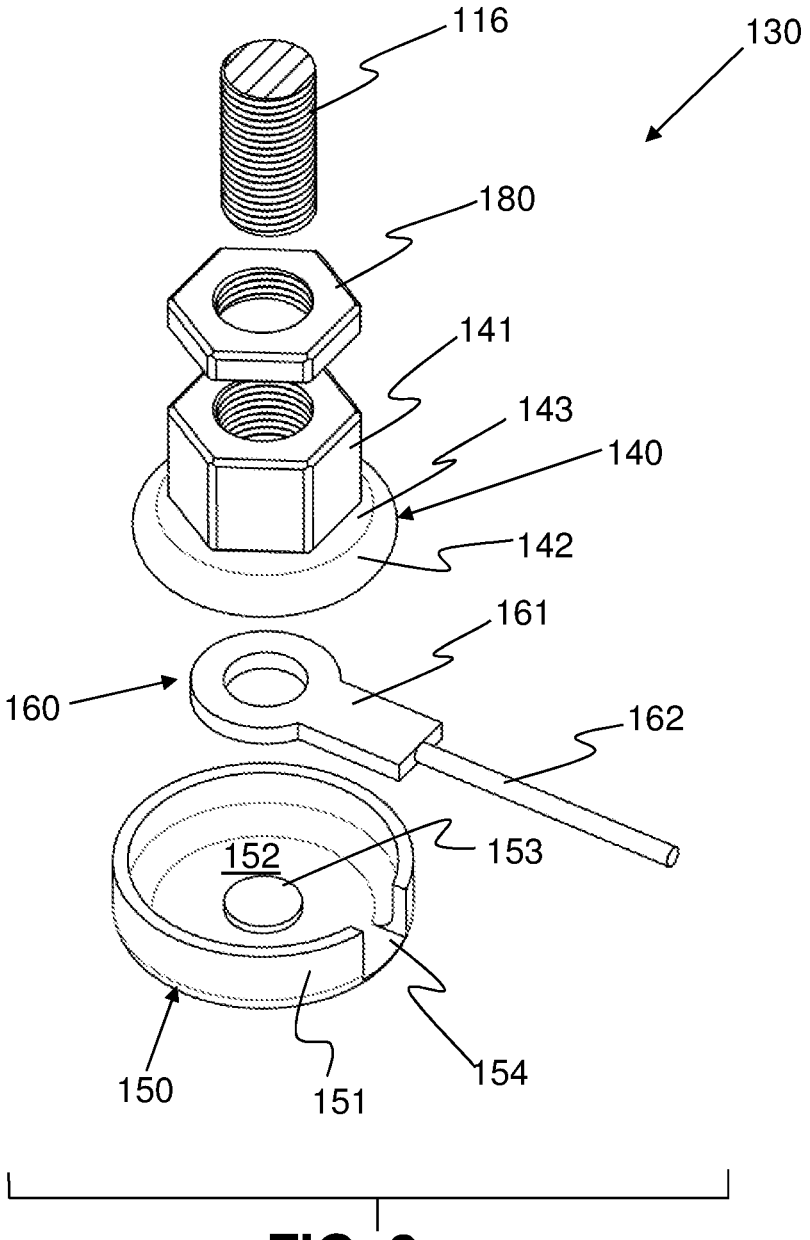
FIG. 3 shows a superior perspective and exploded view of the press-clamp for winding according to the invention.

FIG. 3 shows a superior perspective and exploded view of the press-clamp 130 for winding according to the present invention. The upper plate 140 is of a circular shape with a free inner face 142 and an outer face 143 the outer face 143 is attached to a concentric nut 141 which can be screwed along the threaded bolt 116 of the upper clamping structure of the laminated magnetic core (not shown). The free inner face 142 has a first concentric circular protrusion (not shown).

The clamping force sensor 160 may be of the optoelectric or piezoelectric type, and consists of a ring-shaped body 161 attached to a cable 162. The optoelectric type clamping force sensor 160 is based by sensitivity to a lateral pressure which is correlated with a variation in the light transmission properties of an optical fiber placed within the ring-shaped body 161; the optical fiber deforms as an axial force load is applied, which causes variations in the properties of light transmission that are perceived and transformed into electrical signals which are sent through the cable 162 to be associated with magnitudes of clamping force. An example of an optoelectric type clamping force sensor 160 is the SPASS® Dremodisc commercial model marketed by the German company Rembe Fibre Force GmBH. The piezoelectric type clamping force sensor 160 is based on the piezoelectric effect of a piezoelectric disk within the ring-shaped body 161 which generates voltage changes when deformed by the application of a force, the readings being converted into electrical signals that are sent through cable 162 to be associated with clamping force magnitudes. Examples of a piezoelectric type clamping force sensor 160 are the commercial model LZBS1010 sold by Cooper Instruments and Systems and the FMT Load Washer Cell sold by Measurement Specialties Inc.

The lower plate 150 is of circular shape with a peripheral wall 151 defining a cavity 152 in which the ring-shaped body 161 of the clamping force sensor 160 and the upper plate 140 is housed by its free inner face 142. The cavity 152 of the lower plate 150 has a second concentric circular protrusion 153, and the peripheral wall 151 has a groove 154 which allows the cable 162 of the clamping force sensor 160 to pass therethrough.

Figure 4A:
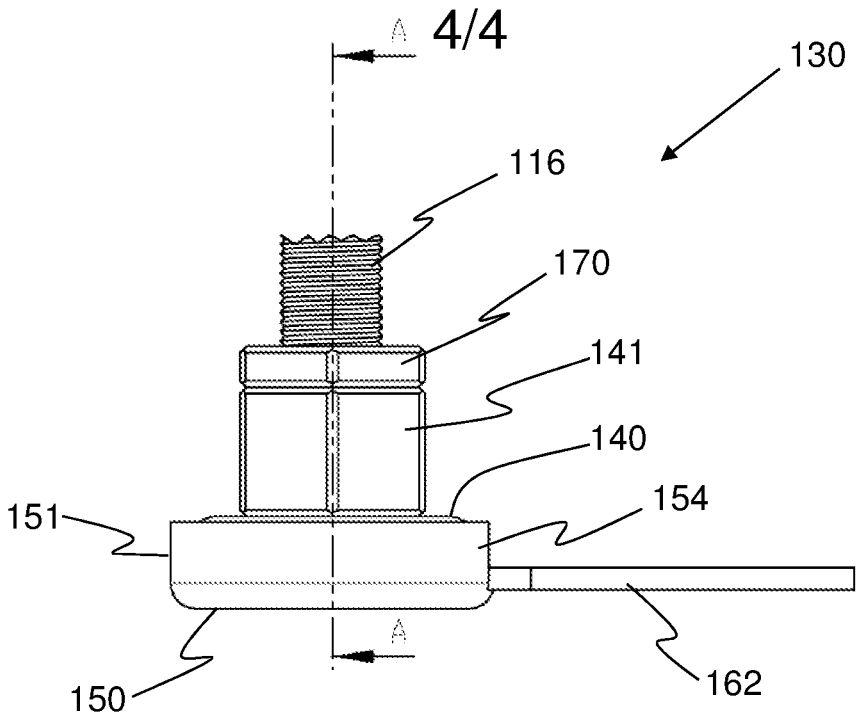
FIG. 4A shows an enlarged view of the press-clamp for winding according to the invention.
Figure 4B:
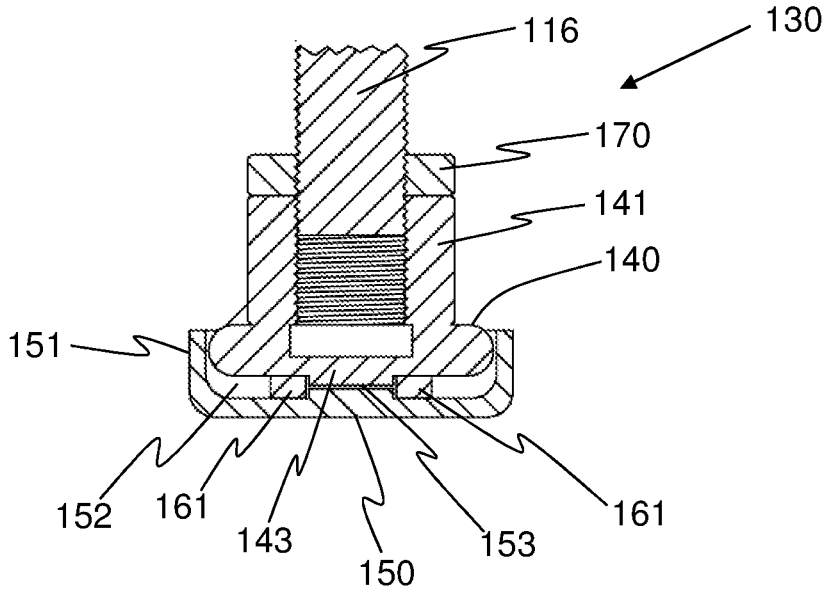
FIG. 4B shows a side sectional view along of line A-A in FIG. 4A of the press-clamp for winding according to the invention.

As seen in FIGS. 4A and 4B, the ring-shaped body 161 of the clamping force sensor 160 is housed in the cavity 152 of the lower plate 150 concentrically to the upper plate 140 and the lower plate 150 in alignment with the first circular protrusion 143 of the upper plate 140 and with the second circular projection 153 of the lower plate 150, while the cable 162 of the clamping force sensor 160 exits from one side of the peripheral wall 151 of the lower plate 150, specifically through the groove 154. The ring-shaped body 161 of the clamping force sensor 160 has a thickness greater than the sum of the thickness of the first circular protrusion 143 of the upper plate 140 and the thickness of the second protrusion 153 of the lower plate 150, while the diameter of the upper plate 140 is smaller than the diameter of the cavity 152 of the lower plate 150, such that the upper plate 140 is moved in vertical direction when threading nut 141 in the threaded bolt 116 of the upper clamping structure of the laminated magnetic core (not shown) by concentrically compressing the ring-shaped body 161 of the clamping force sensor 160 and at the same time by pushing the lower plate 150 in vertical direction to firmly and compressively maintain the winding of the electric transformer, thereby providing a correct measurement of the magnitude of axial clamping force applied to the winding through the press-clamp 130 of the present invention. Once the correct axial clamping force is applied to the winding, the locking nut 170 is screwed to lock the position of the nut 141 of the upper plate 140.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

The invention claimed is:

1. A press-clamp for a winding of an electric transformer, comprising:

an upper plate having a free inner face and an outer face joined to a concentric nut being screwed along a threaded bolt;

a clamping force sensor having a ring-shaped body;

a lower plate having a peripheral wall defining a cavity housing the ring-shaped body of the clamping force sensor and the upper plate by the free inner face; and wherein the free inner face has a first concentric circular protrusion and the cavity of the lower plate has a second concentric circular protrusion, wherein the ring-shaped body of the clamping force sensor is concentric to the upper plate and the bottom plate when aligned with the first concentric circular protrusion and the second concentric circular protrusion.

2. The press-clamp of the claim 1, wherein the clamping force sensor is optoelectric or piezoelectric.

3. The press-clamp of the claim 1, wherein the ring-shaped body of the clamping force sensor has a thickness greater than the sum of the thickness of the first protrusion and the thickness of the second protrusion.

4. The press-clamp of the claim 1, wherein the upper plate and the lower plate are circular in shape, the upper plate having a diameter smaller than the diameter of the cavity of the lower plate.

5. The press-clamp of the claim 1, wherein further the peripheral wall of the lower plate has a groove for passing a cable attached to the ring-shaped body of the clamping force sensor.

6. The press-clamp of the claim 1, wherein further includes a locking nut being screwed along a threaded bolt.

7. An electric transformer comprising:

a laminated magnetic core provided with two or more columns having upper ends interconnected by an upper yoke and lower ends interconnected by a lower yoke;

an upper clamping structure and a lower clamping structure for stabilizing the laminated magnetic core;

a winding concentrically wound on each column, the winding having an upper part; and a plurality of press-clamps for pressing and securing the upper part of each winding to the upper clamping structure of the laminated magnetic core;

the each press-clamp including:

an upper plate having a free inner face and an outer face joined to a concentric nut being screwed along a threaded bolt;

a clamping force sensor having a ring-shaped body;

a lower plate having a peripheral wall defining a cavity housing the ring-shaped body of the clamping force sensor and the upper plate by the free inner face; and wherein the free inner face has a first concentric circular protrusion and the cavity of the lower plate has a second concentric circular protrusion, wherein the ring-shaped body of the clamping force sensor is concentric to the upper plate and the bottom plate when aligned with the first concentric circular protrusion and the second concentric circular protrusion.

8. The electric transformer of the claim 7, wherein the clamping force sensor is optoelectric or piezoelectric.

9. The electric transformer of the claim 7, wherein the ring-shaped body of the clamping force sensor has a thickness greater than the sum of the thickness of the first protrusion and the thickness of the second protrusion.

10. The electric transformer of the claim 7, wherein the upper plate and the lower plate are circular in shape, the upper plate having a diameter smaller than the diameter of the cavity of the lower plate.

11. The electric transformer of the claim 7, wherein further the peripheral wall of the lower plate has a groove for passing a cable attached to the ring-shaped body of the clamping force sensor.

12. The electric transformer according to claim 7, wherein further the press-clamp includes a locking nut being screwed along a threaded bolt.

* * * * *